US007275340B2

(12) United States Patent
Andrews et al.

(10) Patent No.: US 7,275,340 B2
(45) Date of Patent: Oct. 2, 2007

(54) FOUR-SIDED FLEXIBLE DISPLAY TRUCK-SIDE RETENTION SYSTEM

(76) Inventors: Boyd Andrews, 1497 Regency Walk Dr., Decatur, GA (US) 30033; Kenneth Leahy, 2752 Parkview Dr., Atlanta, GA (US) 30345

( * ) Notice: Subject to any disclaimer, the term of this patent is extended or adjusted under 35 U.S.C. 154(b) by 0 days.

(21) Appl. No.: 11/496,076

(22) Filed: Jul. 31, 2006

(65) Prior Publication Data

US 2007/0113448 A1 May 24, 2007

Related U.S. Application Data

(60) Provisional application No. 60/708,885, filed on Aug. 18, 2005.

(51) Int. Cl.
*G09F 21/04* (2006.01)

(52) U.S. Cl. ..... 40/590; 40/603; 40/591

(58) Field of Classification Search ..... 40/590, 40/603; 38/102.91; 160/328, 378
See application file for complete search history.

(56) References Cited

U.S. PATENT DOCUMENTS

| | | | | |
|---|---|---|---|---|
| 1,916,023 | A | 6/1933 | Shull | |
| 3,934,365 | A | 1/1976 | Stein et al. | |
| 4,800,947 | A | 1/1989 | Loomis | |
| 5,046,545 | A | 9/1991 | Loomis et al. | |
| 5,127,177 | A | 7/1992 | Tanner | |
| 5,398,436 | A | 3/1995 | Suzuki | |
| 5,507,109 | A * | 4/1996 | Rinzler | 40/603 |
| 5,588,236 | A | 12/1996 | Suzuki | |
| 5,846,423 | A * | 12/1998 | Jensen | 210/602 |
| 6,250,002 | B1 | 6/2001 | Wittenberg | |
| 6,386,263 | B1 | 5/2002 | Tomlinson et al. | |
| 6,393,746 | B1 | 5/2002 | Jacobson | |
| 6,530,165 | B2 | 3/2003 | Griesemer | |
| 6,594,932 | B2 | 7/2003 | Hurst et al. | |
| 6,782,646 | B1 | 8/2004 | Devaney | |

* cited by examiner

*Primary Examiner*—Cassandra Davis
(74) *Attorney, Agent, or Firm*—Angela H. Smith

(57) ABSTRACT

A system for the framing and tensioning of flexible graphic and advertising displays on vehicles such as trucks, trailers and buildings including a low profile framing system comprised of a custom engineered single rail, designed for ease of installation, minimal impact on the surface of the vehicle, and optimal display of the graphics and advertisements. The top and front rails are attached to the vehicle while the rear and bottom rails are independent of the vehicle to effectuate tensioning and replacement of graphics and advertisements. Tensioning is accomplished through the use of a custom tensioning assembly consisting of a latch, an anchor plate, and a latch hook. The custom tensioning assembly is easily adjusted and firmly secured by the locking mechanism. Corner pieces placed over the four corners of the framing system prevent the introduction of air under the flexible display, thereby ensuring the integrity of the design.

5 Claims, 14 Drawing Sheets

FOUR-SIDED FLEXIBLE DISPLAY TRUCK-SIDE RETENTION SYSTEM

CROSS REFERENCES TO RELATED APPLICATION

This utility application is the non-provisional application of Provisional Application 60/708,885 filed on Aug. 18, 2005.

| U.S. Patent References Cited | |
|---|---|
| U.S. Pat. No. 1916023 | U.S. Pat. No. 6386263 |
| U.S. Pat. No. 3934365 | U.S. Pat. No. 6594932 |
| U.S. Pat. No. 4800947 | U.S. Pat. No. 6782646 |
| U.S. Pat. No. 5046545 | U.S. Pat. No. 6250002 |
| U.S. Pat. No. 5127177 | U.S. Pat. No. 6393746* |
| U.S. Pat. No. 5398436 | U.S. Pat. No. 6530165 |
| U.S. Pat. No. 5588236 | |

(*= closest prior art)

BACKGROUND OF THE INVENTION

1. Field of the Invention

This invention is an advancement in retention systems for flexible displays, and, more particularly, is a retention system for the purpose of placement of graphics and advertisements on trucks, trailers and buildings through the use of a tensioned framing system.

2. Description of Related Art

Many methods exist for the display of advertisements. One of the most common and well known is the billboard. While billboards can consist simply of painted advertisements on a board, they most commonly consist of an adhered or otherwise secured medium that can be easily replaced. In recent years, the use of advertisements on the sides of moving vehicles in a manner reminiscent of billboards has become commonplace. Perhaps in response to the demand for this manner of advertising, the number of systems and methods for effectuating the display of an advertisement on vehicles has steadily increased in recent years. The more successful and versatile of these methods utilize some method of framing a flexible sheet of material containing the advertisement with the frame itself being in some manner attached to the body of the vehicle, most commonly the trailer of a large truck. The use of tensioned flexible sheeting imparts an advantage over other means of advertising, such as painting directly onto the vehicle and the use of adhered panels, because the flexible displays are interchangeable and more impervious to environmental elements than other methods. All of the existing methods, including those utilizing tensioned flexible sheeting, have their limitations.

In developing such a system, a number of factors must be taken into account. These include the restrictions placed on vehicle width by both federal and state law, the impact to the vehicle itself as owners of vehicles prefer that advertising systems impact the vehicle as little as possible, and the appearance of the advertisement once placed on the side of the vehicle particularly with regards to the tendency of flexible sheets to bulge from the introduction of air/wind beneath the sheets while the vehicle is moving. Because of these factors, the most desirable vehicle side advertising systems should consist of a comparably narrow framing system, easily connected and removed from the vehicle with as little impact to the vehicle as possible, capable of displaying the advertisement in a readable manner.

Many variations on tensioning systems have been put forth. U.S. Pat. No. 6,393,746 discloses a framing system using "C-channel" railings to secure a flexible vinyl display with rigid edges by threading the edges into the C-channels and then pulling the panel through the full length of the securing channels. This method is advantageous in that it provides a more simplified means of interchanging advertising panels than what was previously known in the art. However, the rails securing the flexible display consist of multiple metal portions, adding to the cost of production, and complicating installation and interchangeability. The impact to the vehicle is still significant because of the extensive amount of hardware that must be installed to hold the framing system in place. The tensioning mechanism requires the use of carriage bolts to tighten the entire bottom channel, these bolts being difficult to readjust should it become necessary or desirable. The carriage bolts also may have the potential of loosening during transit, causing distortions in the advertising material. Additionally, the use of the C-channel requires that the flexible display be bent in a downward direction at the seam edges, producing unnecessary stress on the display and ultimately leading to premature failure of the display.

U.S. Pat. No. 6,250,002 discloses a framing system with a smaller footprint than that seen in the prior art. This method still requires that the flexible display be bent in a downward direction for display causing stress on the display. The tensioning system also utilizes fastening screws which are subject to loosening and pose issues with ease and speed of readjustment. The framing system itself is completely attached to the vehicle using hardware that visibly impacts the vehicle. Additionally, the complete attachment limits the interchangeability between existing advertisements from vehicle to vehicle because it requires that the flexible display be the exact same size as each other.

A more desirable system would utilize as little hardware as possible in attaching the framing system to the vehicle so as to maintain the structural and aesthetic integrity of the vehicle should the system be removed. Furthermore, the system itself should be aesthetically pleasing, presenting the flexible display as a framed image. Additionally, a more desirable system would ideally utilize a tensioning mechanism that does not place unnecessary stress on the flexible display so as to prolong the life of the display and safeguard the potential for future use of the display. This tensioning mechanism would be composed of stainless steel allowing significant pressure to be applied making the mechanism more secure and creating better tension. This will permit the use of less tension points thereby making the product more reusable and creating a longer product life. The system should be composed of as few parts as possible in order to simplify inventory management, lower the costs of production and the time and difficulty associated with installation, thereby minimizing the labor needed for installation and the downtime required for the vehicle itself. The tensioning mechanism should be easily adjustable, allowing maximum adjustability in display size, should be simple, requiring no special tools with an easy methodology for the tensioning systems, and should not be prone to loosening during transit. The system should employ methods to reduce the introduction of air under the display in order to ensure optimal presentation of the image. An ideal system would utilize a frame that could be adapted to maximize image space on any configuration of vehicle. Additionally, the system should be flexible, utilizing double barrel casings that allow for split advertisements or image display and more economical change-out scenarios. Furthermore, the system should have the ability to accept different size flexible displays without repositioning any of the existing frame hardware. Finally, the system should be lockable, utilizing locking pins or other mechanisms to prevent the unintentional loss of tension and to reduce and discourage tampering with the system.

BRIEF SUMMARY OF THE INVENTION

This invention represents advancement in the area of flexible display retention systems. The framing system consists of a front rail, a top rail, a bottom rail and a rear rail. These rails consist of a custom engineered double barrel casing with flange. First, the top rail and front rail are attached to the vehicle by rivets spaced at uniform intervals along the vehicle. Only the top and front rails are riveted to the vehicle body. Then the flexible display is securely held by inserting its rigid edges into the channels of the top and front rail. The custom engineered double barrel casing permits the flexible display to hang straight down without bending at the rigid edge. Next, the bottom and rear rails are slid into the bottom and back rigid edges of the flexible display. The rear and bottom rail are then attached to the vehicle through the use of custom tensioning assemblies. These custom tensioning assemblies are secured to the rear and bottom rails by using a specially designed latch bar that slides securely into the double barrel casing due to the custom design of the double barrel casing. The latches are further secured to the body of the vehicle by attaching the latch hooks to the anchor plates that are fastened to the bottom edge of the vehicle at uniform intervals. The latches are also secured to the rear of the vehicle by attaching the latch hooks to the anchor plates that are fastened to the rear edge of the vehicle at uniform intervals. Tensioning of the flexible display is accomplished by inserting the latch hook into the appropriate setting on the anchor plate and then drawing the latch toward the anchor plate to provide the desired tension. The latches are then locked in place by inserting a locking mechanism into each latch through the hasp.

BRIEF DESCRIPTION OF THE DRAWINGS

FIG. 11 shows how a split rail can be used to develop two separate image areas and/or go around a door.

| Reference Numbers in Drawings | |
|---|---|
| 1 | Top Rail |
| 2 | Front Rail |
| 3 | Bottom Rail |
| 4 | Rear Rail |
| 5 | Flexible Display |
| 6 | Locking Mechanisms |
| | 6a. Lock Nut |
| | 6b. Padlock |
| | 6c. Lock Pin |
| 7 | Corner Piece |
| 8 | Custom Tensioning Assembly |
| 9 | Flange |
| 10 | Double Barrel Casing |
| 11 | Channels |
| | 11a. Top Channel |
| | 11b. Bottom Channel |
| 12 | Top of Vehicle |
| 13 | Front of Vehicle |
| 14 | Rear of Vehicle |
| 15 | Bottom of Vehicle |
| 16 | Rivets |
| 17 | Latch Bar |
| 18 | Latch |
| 19 | Anchor Plate |
| 20 | Latch Hook |

DETAILED DESCRIPTION OF THE INVENTION

Figure 1:
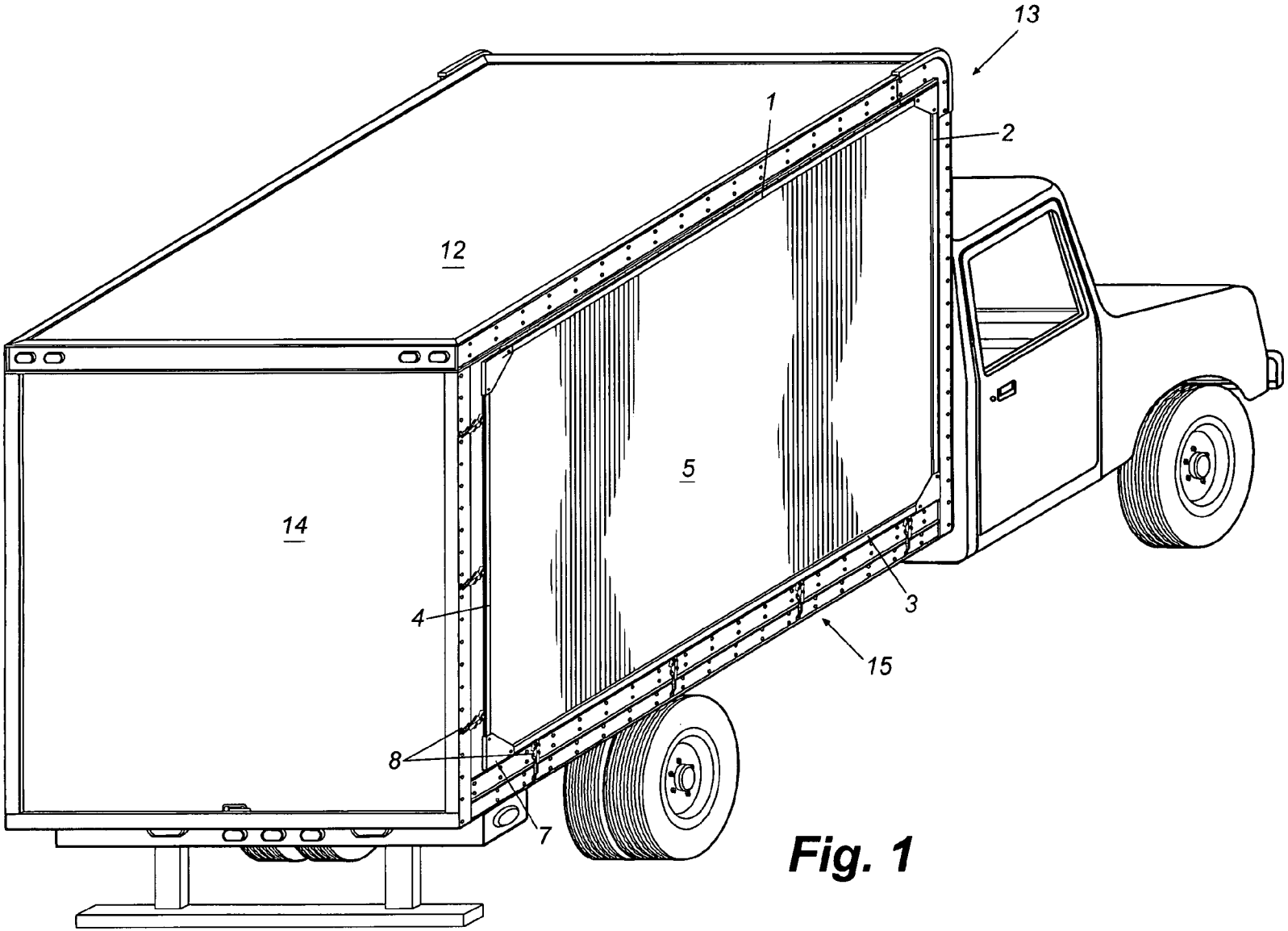
FIG. 1 is a complete view of the retention system affixed to the side of a vehicle with the tensioning mechanism applied.
Figure 2:
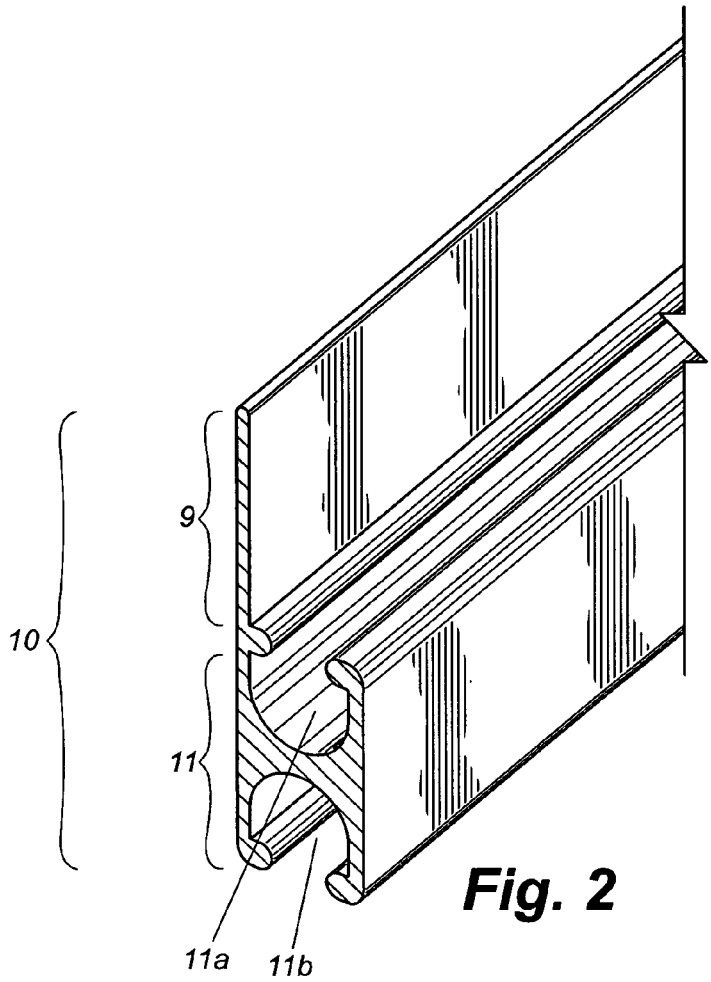
FIG. 2 shows a partial cross-sectional view of the double barrel casing.
Figure 3:
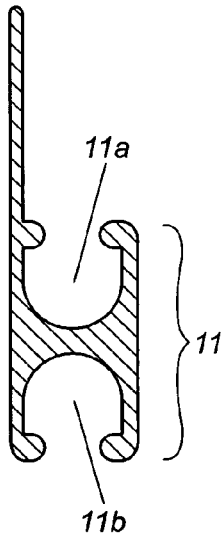
FIG. 3 is a side view of the double barrel casing showing the top and bottom channels.
Figure 4:
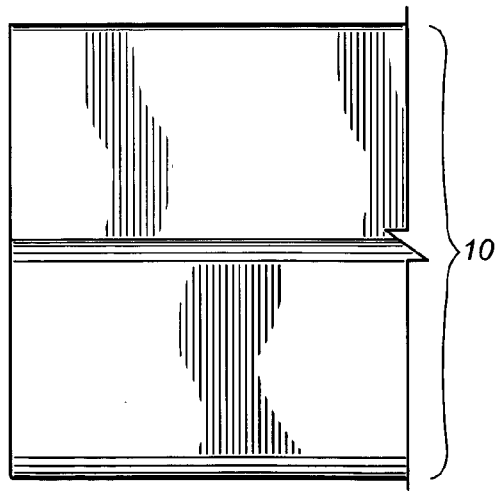
FIG. 4 is a partial front view of the double barrel casing.
Figure 5A:
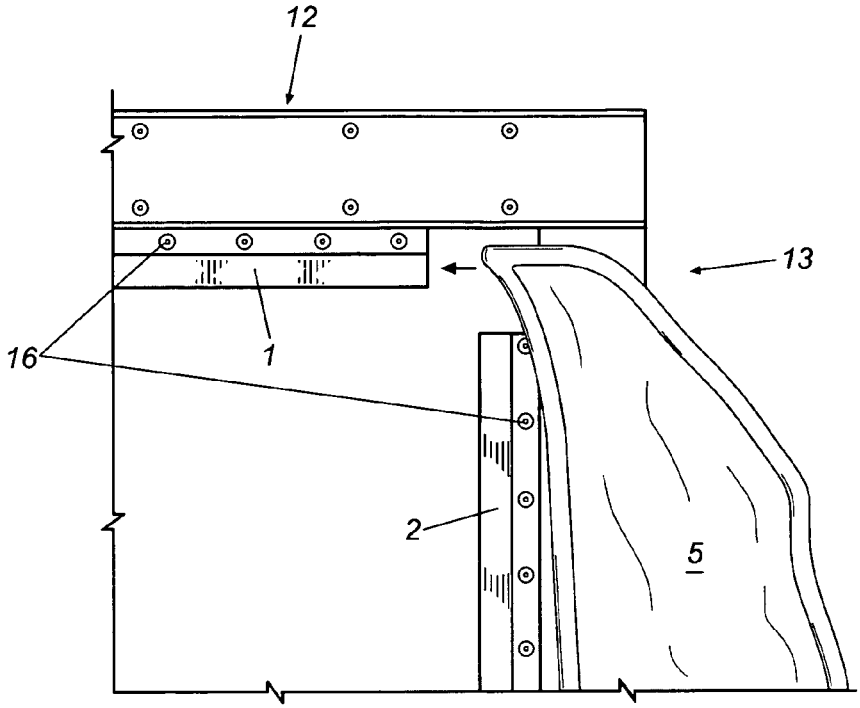
FIGS. 5A and 5B show a partial view of the front top corner of the vehicle demonstrating the manner in which the flexible display is inserted into the top railing and front railing.

Depicted in FIG. 1 is one embodiment of a four sided flexible display truck side retention system presenting features of the present invention. This system consists of a top rail (1) spanning from the front of vehicle (13) to the rear of vehicle (14), a front rail (2) spanning from the top of vehicle (12) to the bottom of vehicle (15), a bottom rail (3) spanning from the front of vehicle (13) to the rear of vehicle (14), and a rear rail (4) spanning from the top of vehicle (12) to the bottom of vehicle (15), all such rails being double barrel casings (10) more thoroughly detailed in FIGS. 2, 3, and 4. As seen in FIGS. 5A and B, the top rail (1) is riveted to the top of vehicle (12), and the front rail (2) is riveted to the front of vehicle (13), by rivets (16) of any sort compatible with the vehicle. The top rail (1) is used to secure the flexible display (5) in place for tensioning from top to bottom. The front rail (2) is used to secure the flexible display (5) in place for tensioning from front to back FIG. 5B.

Figure 5B:
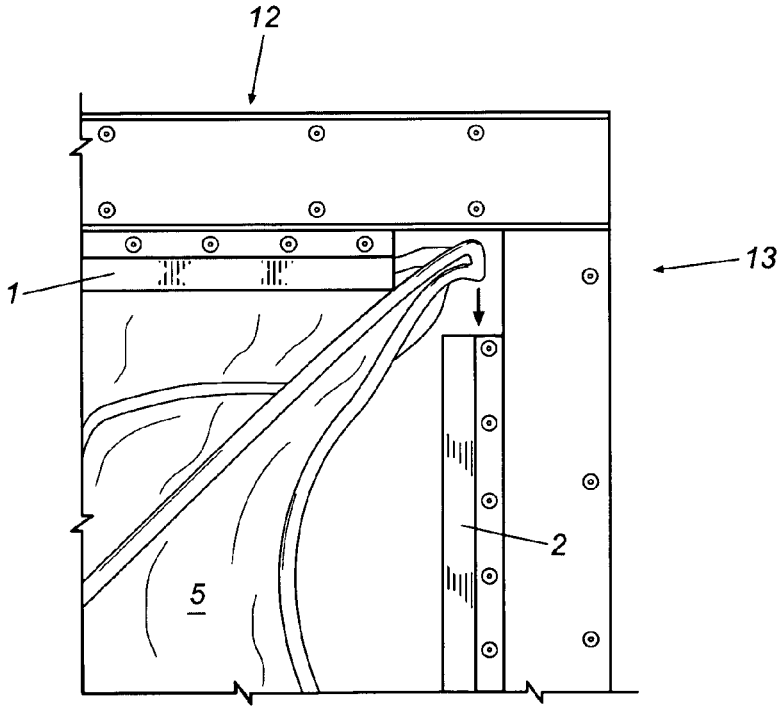

As represented in FIG. 5A, the flexible display (5) is inserted in the bottom channel (11*b*) of the double barrel casing (10) comprising the top rail (1) by threading the top, cylindrical, rigid edge portion of the flexible display (5) into the bottom channel (11*b*) of the double barrel casing (10). As represented in FIG. 5B, the flexible display (5) is inserted in the bottom channel (11*b*) of the double barrel casing (10) comprising the front rail (1) by threading the front, cylindrical, rigid edge portion of the flexible display (5) into the bottom channel (11*b*) of the double barrel casing (10). Not pictured, is the attachment of the bottom rail (3) to the flexible display (5) by sliding the top channel (11*a*) of the double barrel casing (10) comprising the bottom rail (3) over the cylindrical, rigid edge portion of the flexible display (5), and the attachment of the rear rail (4) to the flexible display (5) by sliding the top channel (11*a*) of the double barrel casing (10) comprising the rear rail (4) over the cylindrical, rigid edge portion of the flexible display (5).

The body of the vehicle is further prepared by placing anchor plates (19) along the bottom of vehicle (15) at intervals of approximately three feet for acceptance of the custom tensioning assembly (8), as described in more detail below. The body of the vehicle is further prepared by placing anchor plates (19) along the rear of vehicle (14) at intervals of approximately four to six feet for acceptance of the custom tensioning assembly (8), as described in more detail below.

Figure 6:
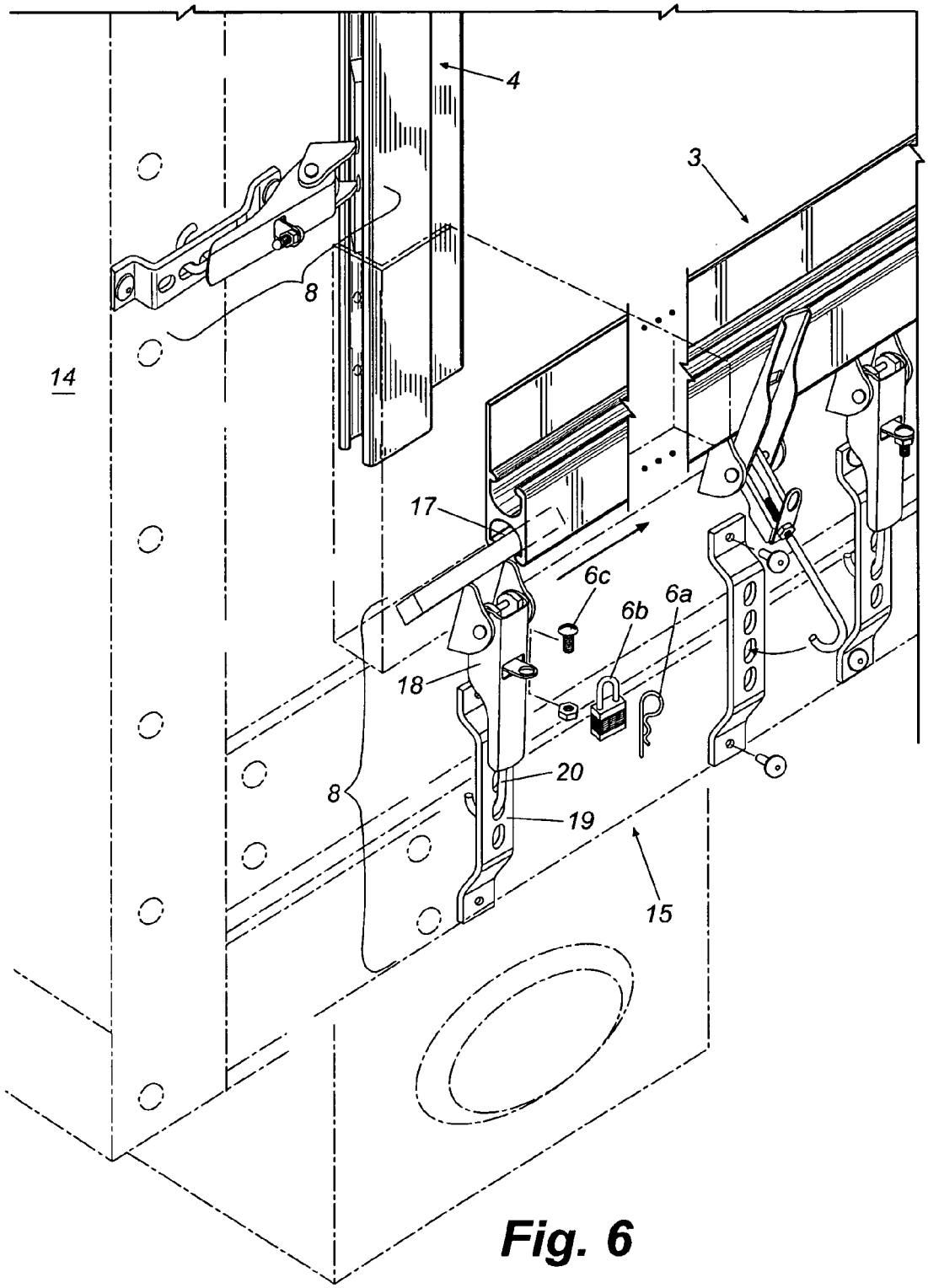
FIG. 6 is a close-up partial view of the lower back corner of the vehicle showing the attachment mechanism for the bottom rail and rear rail and the custom tensioning assembly attached to the double barrel casing composing the bottom rail and rear rail.

The custom tensioning assemblies (8), shown in FIG. 6, are each comprised of a latch bar (17) to be used in securing the custom tensioning assembly (8) to the bottom rail (3) and rear rail (4), a latch hook (20), and an anchor plate (19) that the latch bar (17) is secured into to be used for tensioning the flexible display (5). As depicted in FIG. 6, the custom tensioning assemblies (8) are secured to the bottom rail (3) by sliding the latch bar (17) into the bottom channel (11*b*) of the double barrel casing (10) comprising the bottom rail (3). The custom tensioning assemblies (8) are then secured to the body of the vehicle by hooking to the anchor plate (19) along the bottom of the vehicle (15). Tensioning is achieved by inserting the latch hook (20) into the appropriate setting on the anchor plate (19) and then drawing the latch (18) downward to provide the desired locking tension. As is further depicted in FIG. 6, the custom tensioning assemblies (8) are secured to the rear rail (4) by sliding the latch bar (17) into the bottom channel (11*b*) of the double barrel casing (10) comprising the rear rail (3). The custom tensioning assemblies (8) are then secured to the body of the vehicle by using to latch hooks (20). Tensioning is achieved by drawing the latch (18) toward the stationary anchor plate (19) in order to achieve the desired locking tension. Each custom tensioning assembly (8) is then secured in place by inserting a locking mechanism (6) through the latch (18) to ensure the flexible display (5) remains taut while the vehicle is in transit.

It will be readily apparent to those skilled in the art that a variety of similar tensioning arrangements are possible as alternatives to the custom tensioning assemblies (8). The channels of the double barrel casings are designed to accept multiple tensioning devices. Not shown are possible tensioning arrangements including but not limited to turnbuckles, metal straps, cable ties, and nylon tensioning devices.

Figure 7:
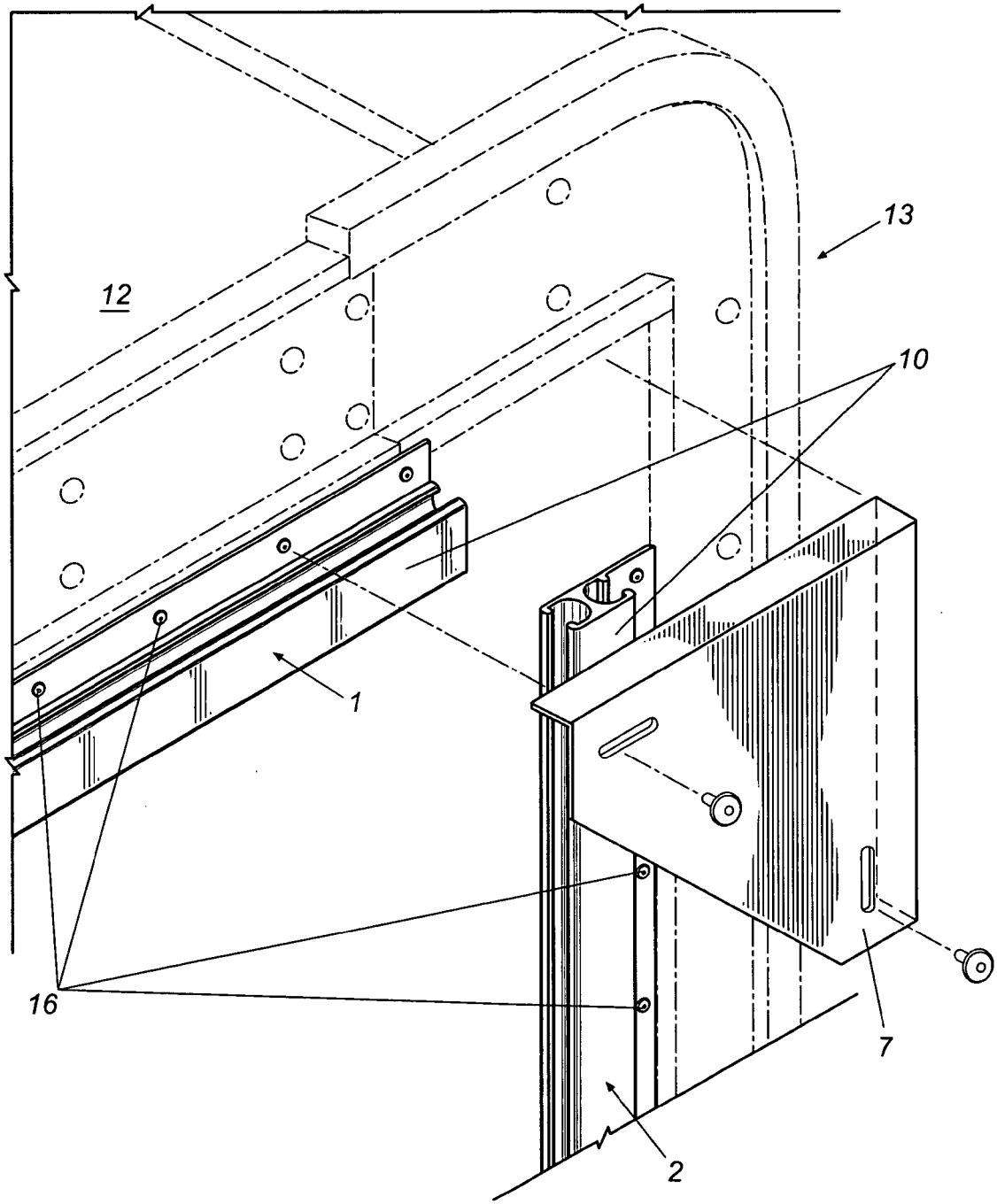
FIG. 7 is a close-up partial view of the front top corner of the vehicle with top rail and front rail attached, further showing a detached corner piece.

FIG. 7 shows in detail how a corner piece (7) is affixed to the intersection of the top rail (1) and front rail (2).

Figure 8A:
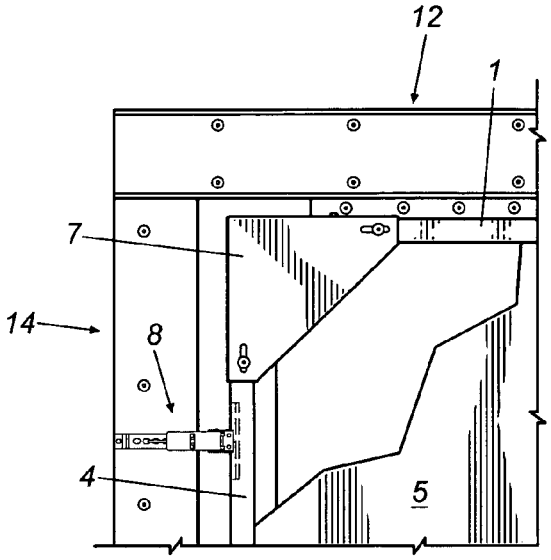
FIGS. 8A and 8B show partial views of the top corners of the vehicle and the custom tensioning assembly attached at the rear rail.
Figure 8B:
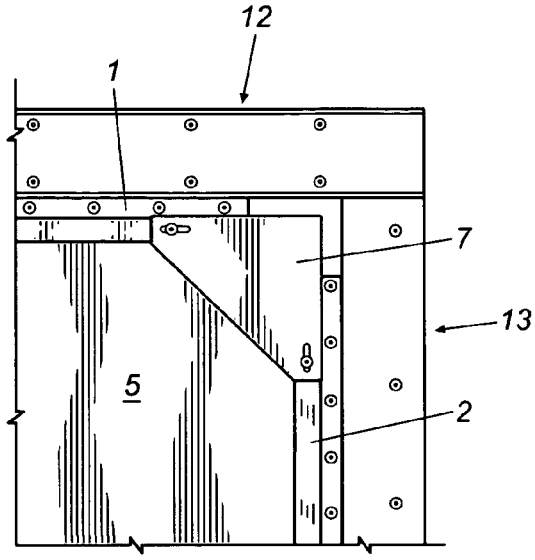
Figure 8C:
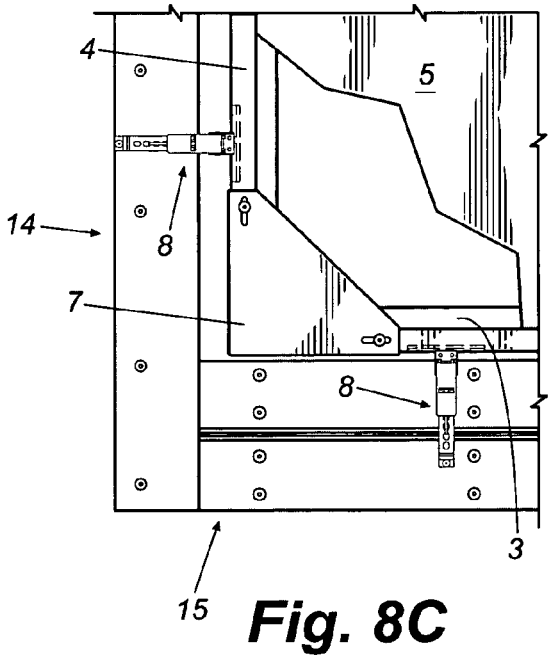
FIGS. 8C and 8D show partial views of the bottom corners of the vehicle and the custom tensioning assembly attached at the rear rail and bottom rail.
Figure 8D:
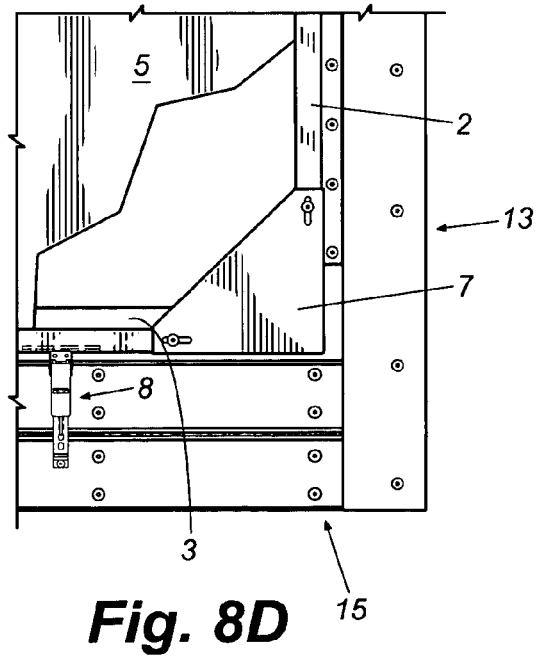

As shown in FIG. 8A, a corner piece (7) is placed at the junction of the top rail (1) and the rear rail (4). As shown in FIG. 8B, a corner piece (7) is placed at the junction of the top rail (1) and the front rail (2). As shown in FIG. 8C, a corner piece (7) is placed at the junction of the bottom rail (3) and the rear rail (4). As shown in FIG. 8D, a corner piece (7) is placed at the junction of the bottom rail (3) and the front rail (2). The corner pieces (7) impede the flow of air under the flexible display (5).

Figure 9:
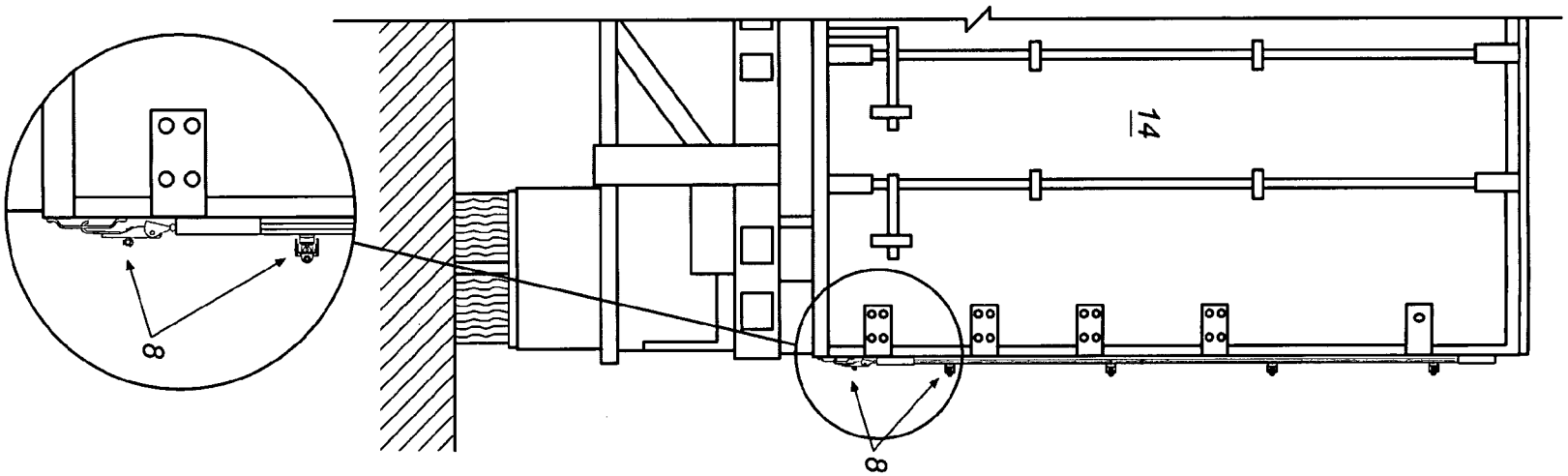
FIG. 9 is a partial view of the back of the vehicle with a close-up view showing the custom tensioning assembly.
Figure 10:
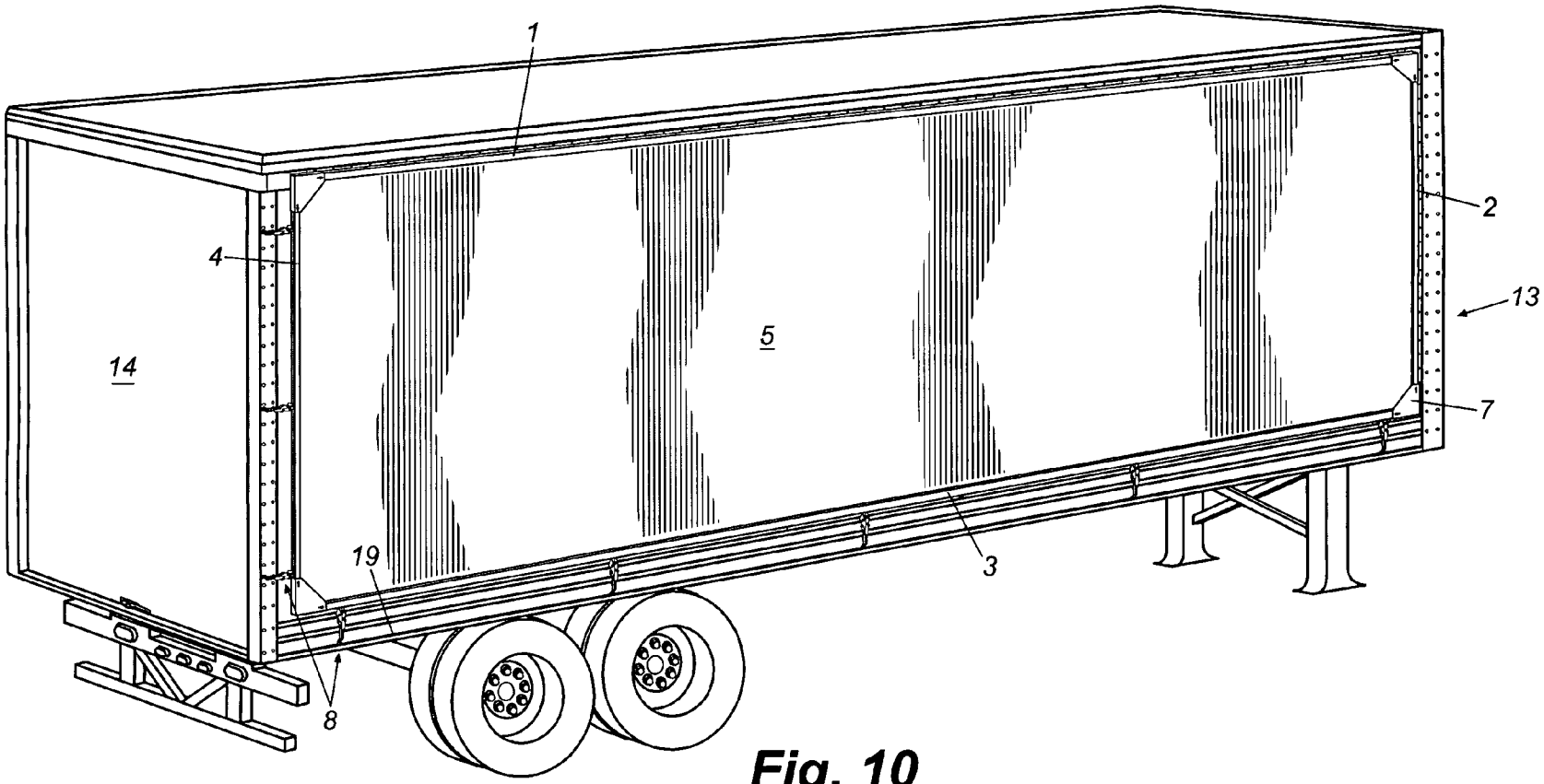
FIG. 10 is a complete view of the retention system affixed to the side of a trailer with the tensioning mechanism applied.
Figure 11:
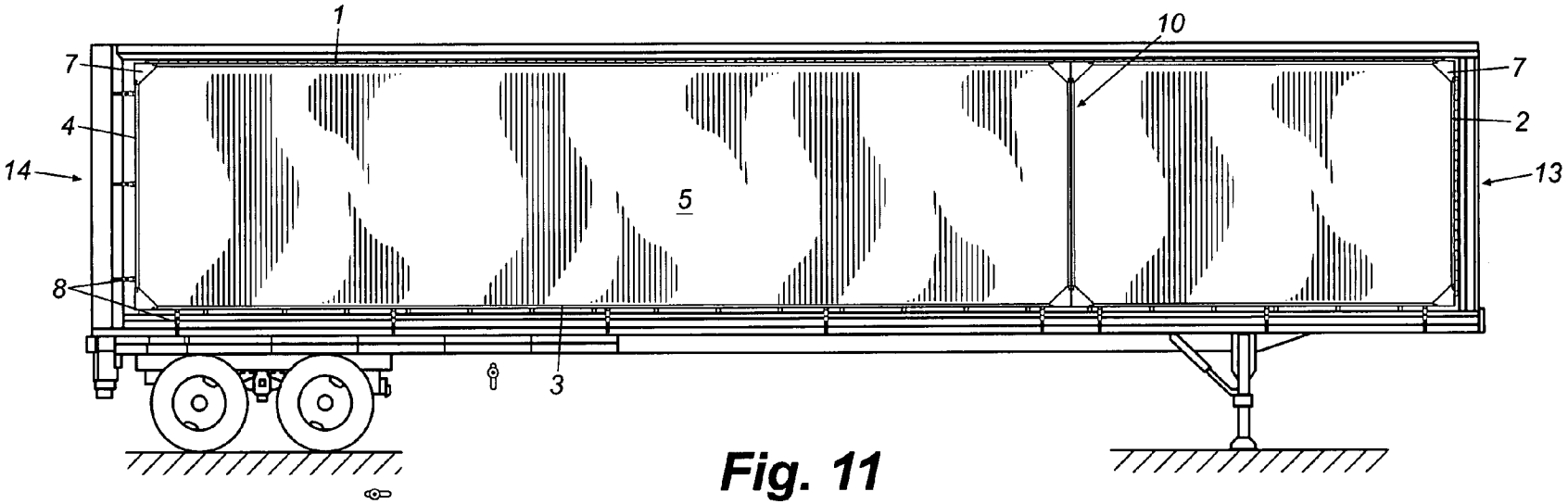
FIGS. 11 and 12 show complete front views of the retention system affixed to the side of trailers of different shapes and sizes demonstrating the versatility of the framing mechanism. Furthermore.
Figure 12:
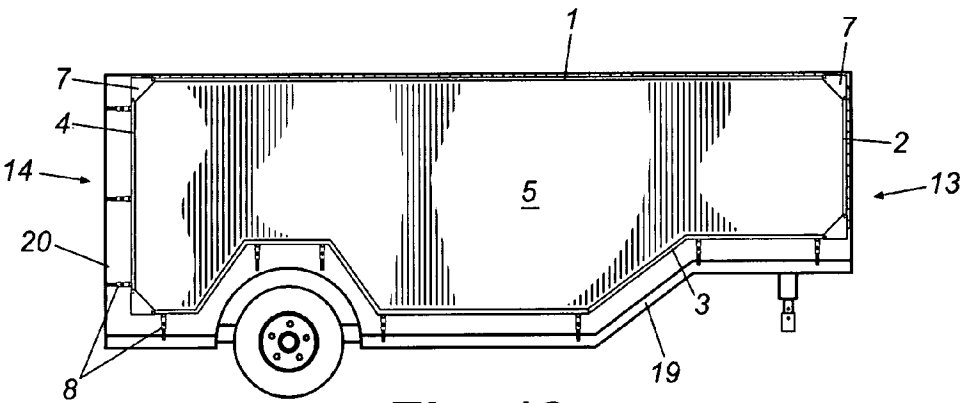
Figure 13:
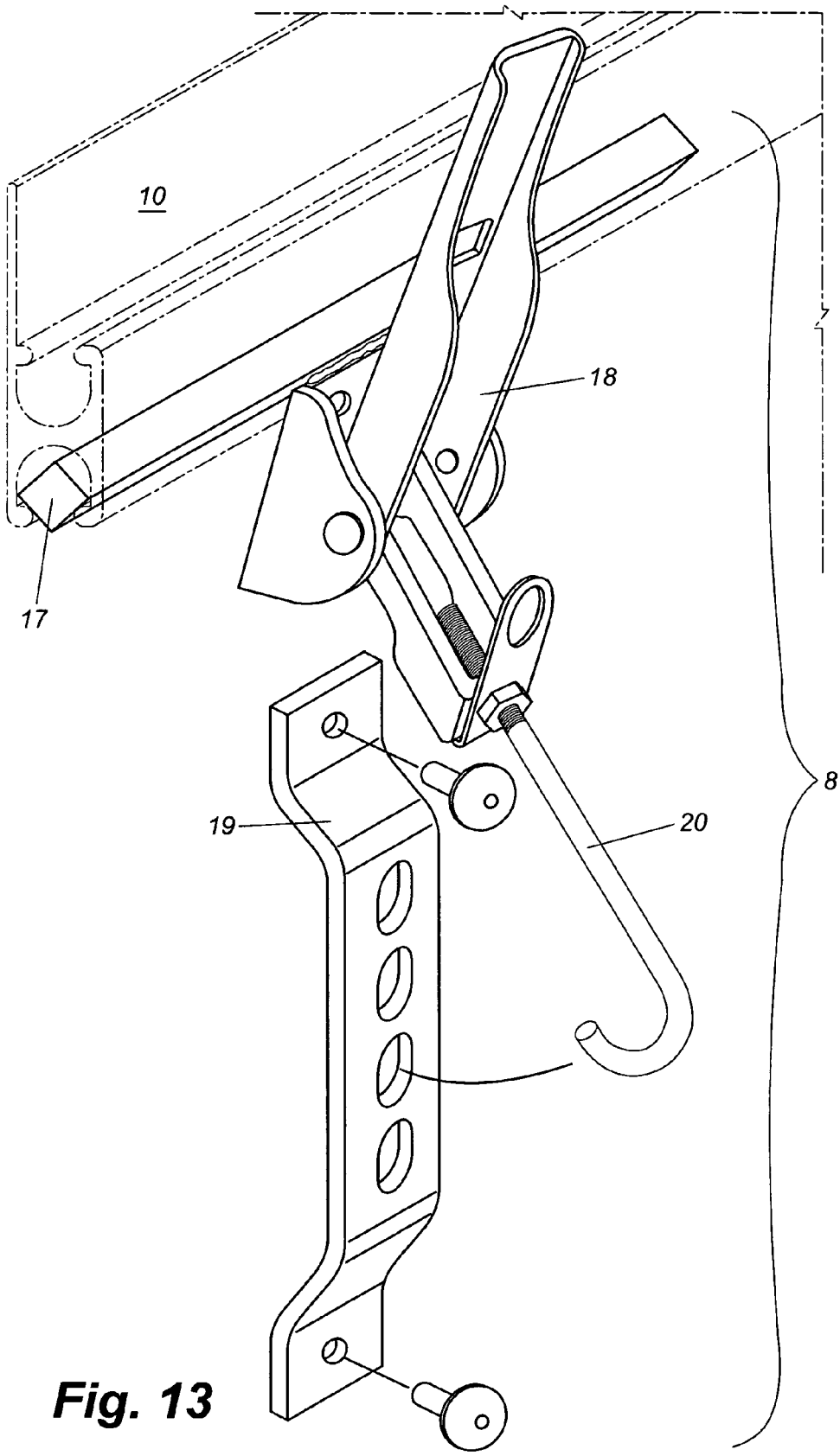
FIG. 13 shows the custom tensioning assembly before tension is applied.
Figure 14:
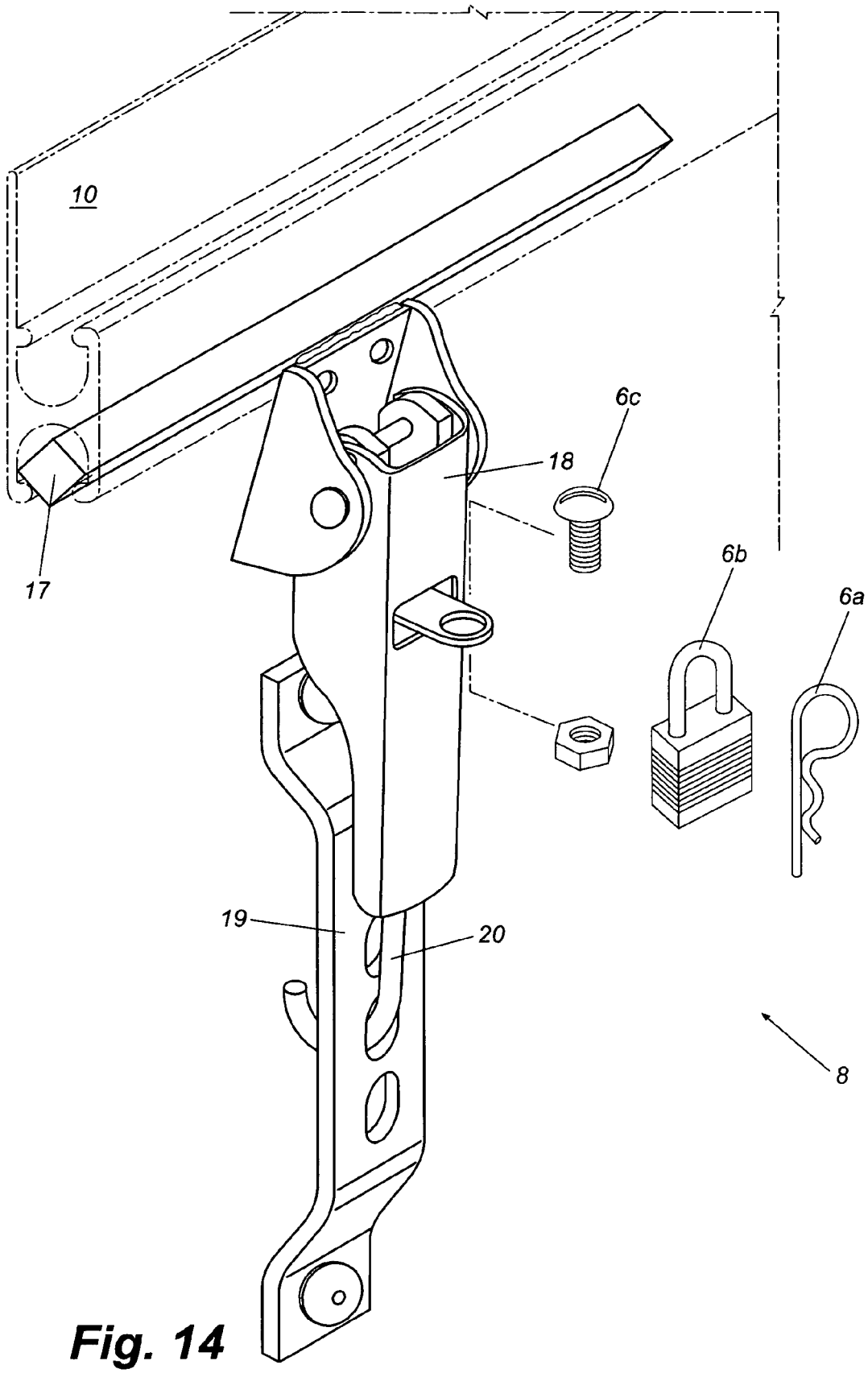
FIG. 14 shows the custom tensioning assembly in the tensioned, locked down position.
Figure 15:
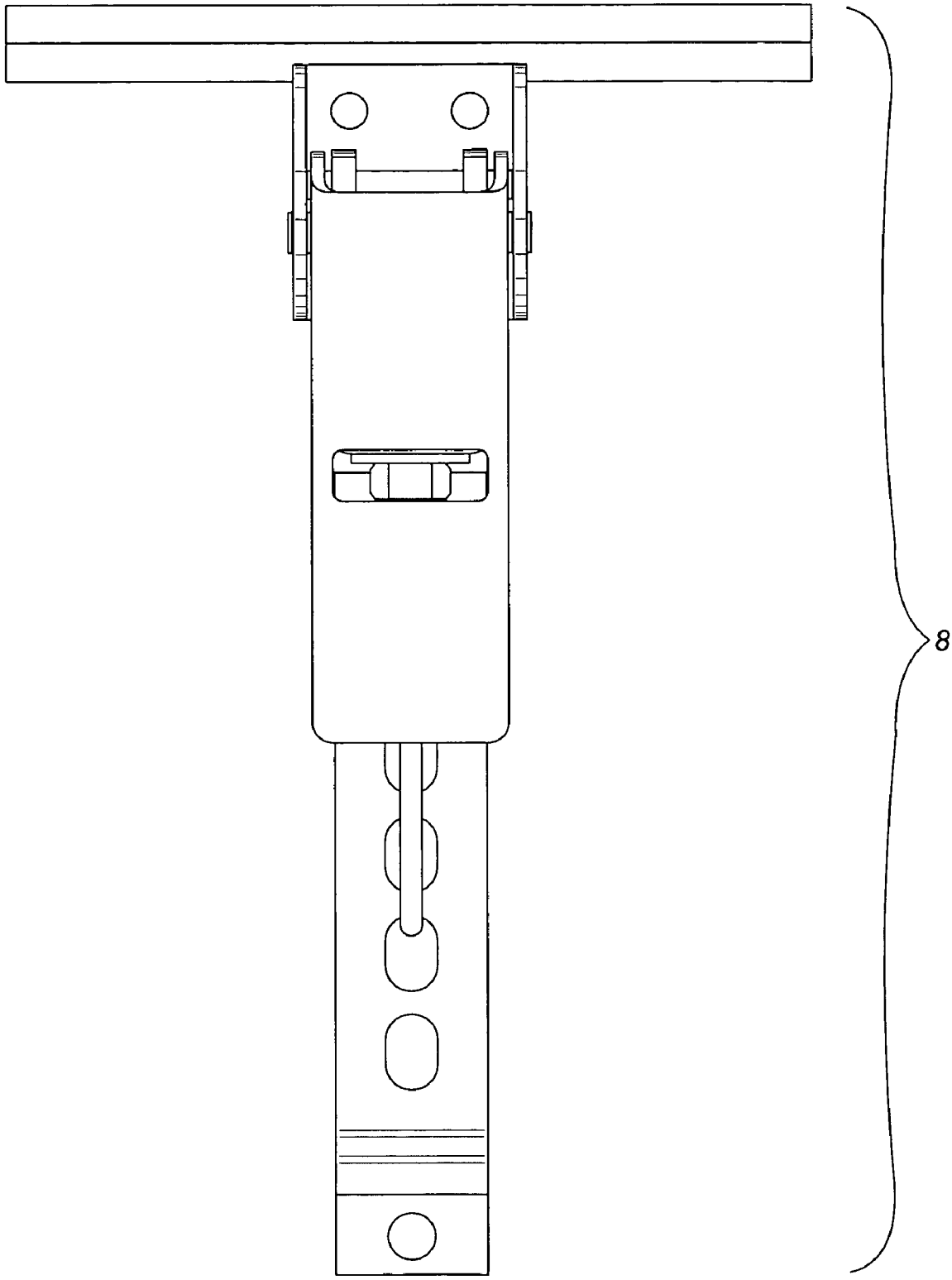
FIG. 15 shows the custom tensioning assembly from a front view.
Figure 16:
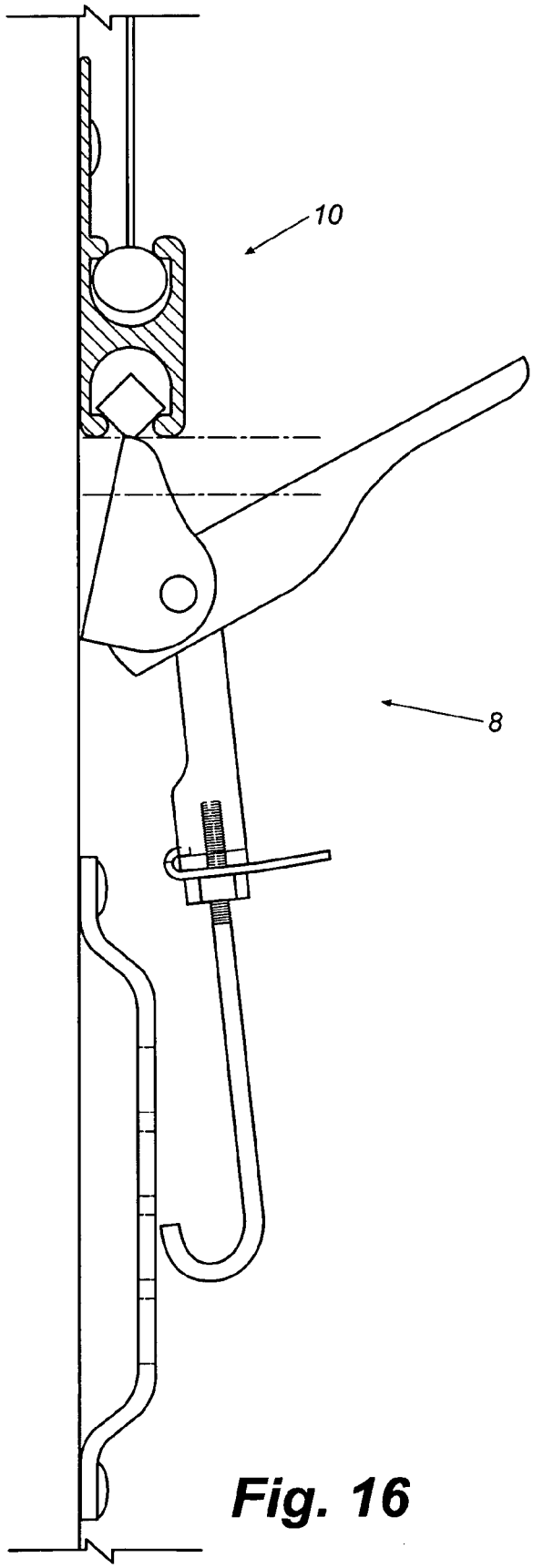
FIG. 16 shows a side view of the custom tensioning assembly.
Figure 17:
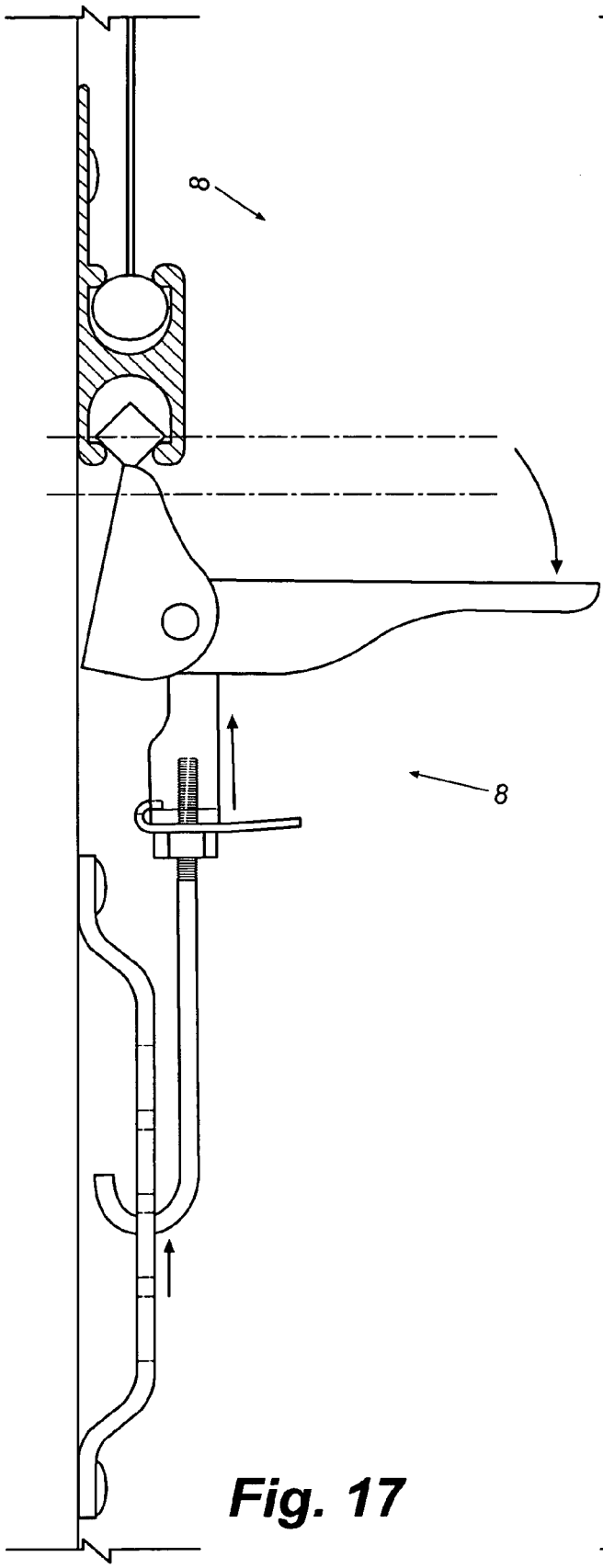
FIG. 17 shows a side view of the custom tensioning assembly before tension is applied.
Figure 18:
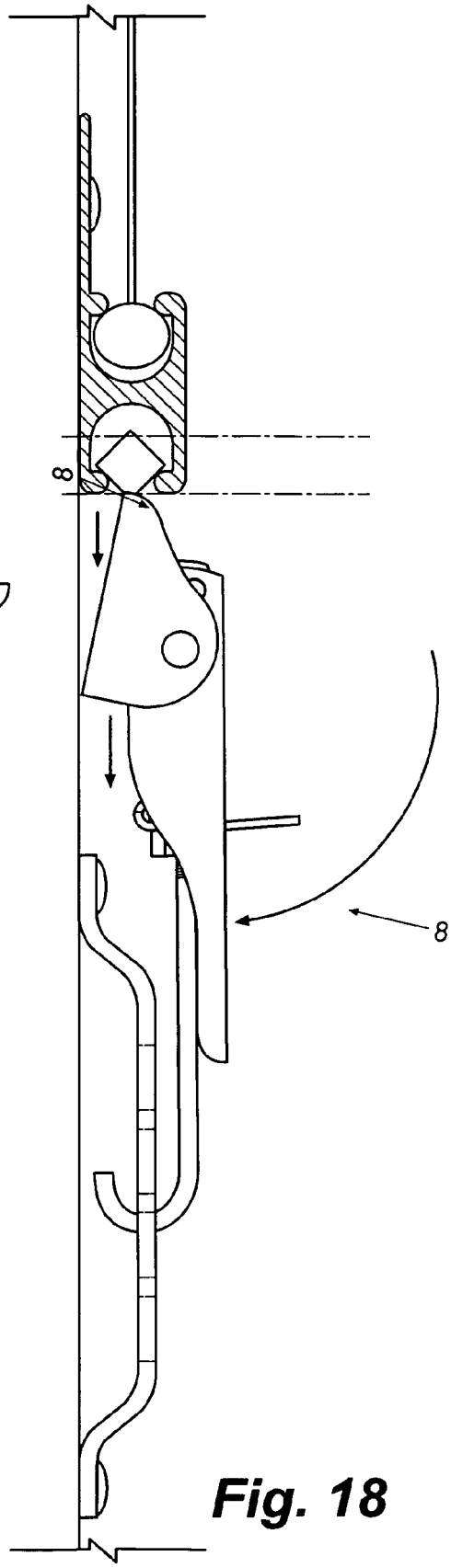
FIG. 18 shows a side view of the custom tensioning assembly in the locked down position.

FIG. 9 shows the optimal method of securing the custom tensioning assemblies (8) to the bottom of the vehicle (15) using the latch (18) and anchor plate (19). FIGS. 10, 11 and 12 show the optimal presentation of a flexible display (5) secured with the custom tensioning assemblies (8) on the sides of varying vehicles.

We claim:

1. A four sided flexible display system capable of being attached to a vehicle consisting of:

a top railing, said top railing having a top and bottom and being a section of double barrel casing having a flange for attachment to the vehicle at the top of the railing, a semi-circular channel at the bottom of the railing and another semi-circular channel immediately above and opposite the bottom semi-circular channel, a front railing, said front railing having a front and back and being another section of the double barrel casing having a flange for attachment to the vehicle at the front of the railing, a semi-circular channel at the back of the railing and another semi-circular channel immediately in front of and opposite the back semi-circular channel, a bottom railing, said bottom railing having a top and bottom and being a third section of the double barrel casing having a flange at the top of the bottom railing, a semi-circular channel at the bottom of the railing and another semi-circular channel immediately above and opposite the bottom semi-circular channel, a rear railing, said rear railing having a front and back and being a fourth section of the double barrel casing having a flange at the front of the rear railing, a semi-circular channel at the back of the railing and another semi-circular channel immediately in front of and opposite the back semi-circular channel, a flexible display, said display having a top length approximately the same top length as the top railing, said display having a front length approximately the same front length as the front railing, said display having a bottom length approximately the same bottom length as the bottom railing, said display having a rear length approximately the same rear length as the rear railing, said display having a top, cylindrical, rigid edge portion, of sufficient circumference to fit within the bottom channel of the top railing, said rigid edge portion being fitted into the bottom channel of the top railing, said display having a front, solid, cylindrical rigid edge portion, of sufficient circumference to fit within the back channel of the front railing, said rigid edge portion being fitted into the back channel of the front railing, said display having a bottom, solid, cylindrical rigid edge portion, of sufficient circumference to fit within the top channel of the bottom railing, said rigid edge portion being fitted into the top channel of the bottom railing, said display having a rear, solid, cylindrical rigid edge portion, of sufficient circumference to fit within the front channel of the rear railing, said rigid edge portion being fitted into the front channel of the rear railing, a means for tensioning the flexible display consisting of, custom tensioning assemblies each comprising, a latch an anchor plate, a latch hook, a locking mechanism, said anchor plates being spaced at regular intervals along a bottom edge of the vehicle, said anchor plates being further spaced at regular intervals along a rear edge of the vehicle, said latches being slid into the bottom channel of the bottom rail at regular intervals, said latches being slid into to the bottom channel of the bottom rail being further secured to the anchor plate, said latches being slid into to the back channel of the rear rail at regular intervals, said latches attached to the back channel of the rear rail being further secured to the anchor plate, wherein the custom tensioning assemblies are locked by applying tension with the latches of the bottom rail by drawing the latches toward the anchor plates until the desired tension is achieved in the flexible display and the bottom rail is secured to the vehicle, applying tension with the latches by drawing the latches toward the anchor plates until the desired tension is achieved in the flexible display and the rear rail is-secured to the vehicle, securing the latches in the tightened position by inserting the latch hook into the appropriate setting on the anchor plate, locking the custom tensioning assemblies into the locked position by engaging the locking mechanism.

2. The flexible display system of claim 1 further comprising:

corner pieces, said corner pieces being placed over a intersection of the top and front rails, the top and rear rails, the rear and bottom rails and the bottom and front rails.

3. The flexible display system of claim 1 further comprising:

the anchor plates being spaced at approximately four to six foot interval along the bottom of vehicle.

4. The flexible display system of claim 1 further comprising:

the anchor plates being spaced at approximately three foot interval along the rear of vehicle.

5. The flexible display system of claim 1 wherein the flexible display is composed of vinyl.

* * * * *